US006844680B2

(12) United States Patent
Yoshihara et al.

(10) Patent No.: US 6,844,680 B2
(45) Date of Patent: Jan. 18, 2005

(54) MAGNETRON HAVING SPECIFIC DIMENSIONS FOR SOLVING NOISE PROBLEM

(75) Inventors: Masanori Yoshihara, Imaichi (JP); Toshiyuki Tsukada, Utsunomiya (JP); Hideki Ohguri, Tochigi (JP); Etsuo Saitou, Tochigi (JP); Takeshi Isii, Oyama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/621,092

(22) Filed: Jul. 16, 2003

(65) Prior Publication Data

US 2004/0012349 A1 Jan. 22, 2004

(30) Foreign Application Priority Data

Jul. 18, 2002 (JP) ..... P.2002-209773
Apr. 15, 2003 (JP) ..... P.2003-110390

(51) Int. Cl.[7] ..... H01J 25/50
(52) U.S. Cl. ..... 315/39.51; 315/39.69
(58) Field of Search ..... 315/39.51, 39.57, 315/39.67, 39.69, 39.75; 313/38, 238

(56) References Cited

U.S. PATENT DOCUMENTS 4,705,989 A * 11/1987 Takada et al. ..... 315/39.51
4,720,659 A * 1/1988 Aiga et al. ..... 315/393.69
4,742,272 A * 5/1988 Kusano et al. ..... 315/39.69
5,049,782 A * 9/1991 Aiga et al. ..... 315/39.51
5,180,946 A * 1/1993 Aiga et al. ..... 315/39.51
5,635,797 A 6/1997 Kitakaze et al. ..... 315/39.51
6,078,141 A * 6/2000 Hoh ..... 315/39.375

FOREIGN PATENT DOCUMENTS

JP 6-101304 12/1994
JP 2003-59413 2/2003

OTHER PUBLICATIONS

Patent Abstracts of Japan, Okamura Toshio, "Magnetron For Microwave Oven", Publication No.: 62113336, Publication Date: May 25, 1987, 1 page.
Patent Abstracts of Japan, Ito Yuichi, "Magnetron", Publication No.: 06052805, Publication Date: Feb. 25, 1994, 1 page.
Patent Abstracts of Japan, Miura Heicachi, "Magnetron", Publication No.: 08153472, Publication Date: Jun. 11, 1996, 1 page.
Patent Abstracts of Japan, Miki Kazuki, "Magnetron", Publication No.: 11306997, Puiblication Date: Nov. 5, 1999, 1 page.

* cited by examiner

*Primary Examiner*—Thuy Vinh Tran
(74) *Attorney, Agent, or Firm*—Pearne & Gordon LLP

(57) ABSTRACT

In such a case that a radial dimension of an outer circumference of a small-diameter strap ring of a magnetron is equal to "Rs1", a radial dimension of an inner circumference of a large-diameter strap ring is equal to "Rs2", a radius of a circumference which is inscribed to tip portions of anode vanes is equal to "Ra", and a radius of a central flat portion of a magnetic piece, which is located in the vicinity of each of the anode vanes, is equal to "Rp", the respective values of Ra, Rs1, Rs2, Rp are set in such a manner that the below-mentioned formulae (1) and (2) can be established:

$$1.85Ra \leqq (Rs1+Rs2)/2 \leqq 1.96Ra \quad (1)$$

$$Rs1<Rp<Rs2 \quad (2).$$

3 Claims, 8 Drawing Sheets

MAGNETRON HAVING SPECIFIC DIMENSIONS FOR SOLVING NOISE PROBLEM

BACKGROUND OF THE INVENTION

The present invention is related to a magnetron employed in high frequency heating appliances such as microwave ovens and the like.

FIG. 11 indicates an example of a conventional magnetron 1 which is assembled in a microwave oven, or the like.

This magnetron 1 contains a cathode 3 whose central axis is directed along upper/lower directions, an anode tubular body 5 which coaxially encloses this cathode 3, an input-sided magnetic piece 7, a cathode-terminal conducting stem 31, an output-sided magnetic piece 13, a second metal cylinder 15, and a microwave radiating antenna 19. The input-sided magnetic piece 7 is provided at a lower opening end of the anode tubular body 5. The cathode-terminal conducting stem 31 is formed in such a way that this cathode-terminal conducting stem 31 is projected from a first metal cylinder 9 which covers this input-sided magnetic piece 7. The output-sided magnetic piece 13 is provided on an upper opening end of the anode tubular body 5. The second metal cylinder 15 covers this output-sided magnetic piece 13. The microwave radiating antenna 19 is formed on the second metal cylinder 15 in such a manner that this antenna 19 is projected via an insulating tube 17 made of ceramics from the second metal cylinder 15.

A plurality of anode vanes 20 are joined to an inner wall plane of the anode tubular body 5 in a radial shape, which are directed to a center axis of the anode tubular body 5. A strap-engaging concave portion 20*a* and a strap-inserting concave portion 20*b* are provided on an upper edge and a lower edge of each of these anode vanes 20 in such a manner that the position of the strap-engaging concave portion 20*a* is positionally shifted with respect to the position of the strap-inserting concave portion 20*b* along a radial direction, and both the strap-engaging concave portion 20*a* and the strap-inserting concave portion 20*b* are arranged in a reverse manner with respect to the upper edge and the lower edge. The strap-engaging concave portion 20*a* is employed so as to join a strap ring, whereas the strap-inserting concave portion 20*b* is employed so as to insert thereinto the strap ring in a non-contact manner.

Then, these anode vanes 20 arranged along a circumferential direction are electrically connected to each other every one vane, while any one of two strap rings 22 and 24 is joined to the strap-engaging concave portion 20*a*. These strap rings are a small-diameter strap ring 22 and a large-diameter strap ring 24, which are arranged on the center axis of the anode tubular body 5 in a coaxial manner.

One magnetic pole of a first ring-shaped permanent magnet 21 is magnetically coupled to the input-sided magnetic piece 7. This first ring-shaped permanent magnet 21 is made of ferrite, and is stacked on the outer edge plane of the input-sided magnetic piece 7 in a ring shape by which the first metal cylinder 9 is surrounded. Also, one magnetic pole of a second ring-shaped permanent magnet 23 is magnetically coupled to the output-sided magnetic piece 13. This second ring-shaped permanent magnet 23 is made of ferrite, and is stacked on the outer edge plane of the output-sided magnetic piece 13 in a ring shape by which the second metal cylinder 15 is surrounded.

A frame-shaped yoke 25 owns a through hole 25*a* which is used to insert the cathode-terminal conducting stem 31 into a lower edge portion thereof, while this frame-shaped yoke 25 is employed so as to magnetically couple the other magnetic pole of the first ring-shaped permanent magnet 21 to the other magnetic pole of the second ring-shaped permanent magnet 23.

Also, a large number of heat radiation fins 27 are mounted in a multiple stage on the outer peripheral plane of the anode tubular body 5. A metal filter case 29 is mounted on an outer surface of a lower edge portion of the frame-shaped yoke 25, while this metal filter 29 is employed in order to avoid such a condition that leaked electromagnetic waves are leaked out from the magnetron 1. The cathode-terminal conducting stem 31 having a smaller diameter than a diameter of the through hole 25*a* of the frame-shaped yoke 25 is tightly soldered to the first metal cylinder 9, while a cathode terminal 11*a* penetrates through an inner side of this cathode-terminal conducting stem 31, and then, is electrically connected to a lead wire 11.

A feed-through type capacitor 33 is mounted on a side surface portion of this filter case 29, whereas one end of a choke coil 35 is connected to the cathode terminal 11*a* of the cathode-terminal conducting stem 31 positioned within the filter case 29. The other end of this choke coil 35 is connected to a feed-through electrode of the capacitor 33 in order to constitute an LC filter circuit capable of preventing leaked electromagnetic waves.

In the conventional magnetron 1 constructed in the above-described manner, a choke ring 37 having a ¼-wavelength along the axial direction thereof is tightly soldered to the metal tube 15 in order to suppress high frequency noise which has been leaked on the side of the microwave radiating antenna 19.

On the other hand, as to magnetrons, there are regulations in order to prevent radiation noise (noise leakage) with respect to high frequency components, relatively-low frequency components of 30 to 1,000 MHz, and furthermore, base wave components (both bandwidths and sideband levels). In particular, there is a sever regulation with respect to the fifth harmonic wave.

The equipment of only the above-described choke ring 37 cannot sufficiently prevent radiation noise/leakages so as to clear such regulations for the radiation noise.

In general, when a spectrum of a base wave may become a clear waveform having a reduced sideband, an spectrum of an n-th wave (higher harmonic wave) also may become a clear waveform, so that radiation noise may be lowered. It should be understood that the generation of the sideband on the spectrum of the base wave is greatly influenced by a radius "Rp" of a central flat portion of the output-sided magnetic piece 13.

With respect to the flat portion of the output-sided magnetic piece 13, changes in the spectra of the base wave are represented in FIG. 12(*a*) to FIG. 12(*e*) when the radius "Rp" of this flat portion is gradually increased in a flat region in the proximity to each of the anode vanes 20 in order to concentrate magnetic flux into the effective space within the anode tubular body 5.

In FIG. 12(*a*) to FIG. 12(*e*), when a radial dimension of an outer circumference of the small-diameter strap ring 22 was "Rs1" and a radial dimension "Rs2" of an inner circumference of the large-diameter strap ring 24, while these radial dimensions "Rs1" and "Rs2" were employed as a reference radius, base wave spectra was measured by increasing/decreasing the radius "Rp" of the above-explained flat portion.

FIG. 12(*a*) shows a base wave spectrum when Rp<Rs1; FIG. 12(*b*) indicates a base wave spectrum when Rp=Rs1;

FIG. 12(*c*) shows a base wave spectrum when Rp=(Rs1+Rs2)/2; FIG. 12(*d*) indicates a base wave spectrum when Rp=Rs2; and FIG. 12(*e*) shows a base wave spectrum when Rp<Rs2.

As apparent from the respective diagrams, such a trend is represented. That is, when the radius "Rp" of the flat portion of the output-sided magnetic piece 13 is increased (namely, difference with respect to choke diameter is widened), the generations of the sidebands are reduced in response to this increased radius, and thus, the resulting spectra may become clear.

In an actual case, when a noise level in the vicinity of 2.4 GHz is measured, as indicated in FIG. 13, the noise level is rapidly attenuated if the radius "Rp" of the flat portion exceeds the radial dimension "Rs1" of the small-diameter strap ring 22.

Accordingly, generally speaking, considering such a trend, the conventional magnetrons have been manufactured so as to capable of preventing the radiation noise/leakages, since the radius "Rp" of the flat portion of the output-sided magnetic piece 13 is made larger than the radial dimension of the large-diameter strap ring 24.

However, when the radius "Rp" of the flat portion of the output-sided magnetic piece 13 is made larger than the radial dimension of the large-diameter strap ring 24, although the reduction of the radiation noise can be realized, there is such a problem that, as may be understood from the base wave spectrum level of FIG. 12(*e*), the oscillation efficiency is lowered.

Very recently, a specific attention has been paid to noise in the 2.2 GHz range (band) among the radiation noise. There is such a trend that this noise of the 2.2 GHz range easily may be produced when the oscillation efficiency is increased. FIG. 10 shows a noise waveform of the 2.4 GHz range, and also, a noise waveform of the 2.2 GHz range. In this drawing, a right portion corresponds to the noise in the 2.4 GHz range and a left portion corresponds to the noise in the 2.2 GHz range, as viewed in the drawing.

SUMMARY OF THE INVENTION

To solve such a noise generation problem, the Inventors of the present invention could obtain new knowledge, since these Inventors precisely analyzed the dimensions of the flat portions of the output-sided magnetic pieces, and correlative relationships among these anode vanes, and the dimensions of the respective strap rings.

The present invention has been made to solve the above-described problem based upon the above-explained knowledge, and therefore, has an object to provide a magnetron capable of reducing radiation noise in a sufficiently low level, and furthermore, capable of avoiding lowering of an oscillation efficiency, so that the oscillation efficiency can be improved.

To achieve the above-described object, a magnetron according to the present invention is featured by such a magnetron in which both a strap-engaging concave portion for joining a strap ring and a strap-inserting concave portion for inserting therethrough the strap ring in a non-contact manner are provided on an upper edge and a lower edge of each of anode vanes in such a manner that the strap-engaging concave portion and the strap-inserting concave portion are positionally shifted from each other along a radial direction of an anode tubular body; the anode vanes arranged along a circumferential direction are electrically connected to each other every one vane by that any one of two sets of strap rings, i.e., a small-diameter strap ring and a large-diameter strap ring, which are coaxially arranged with respect to a center axis of the anode tubular body, is joined to the strap-engaging concave portion; and a microwave radiating antenna which passes through an output-sided magnetic piece in a non-contact manner is joined to one anode vane among the plural anode vanes; wherein:

in such a case that a radial dimension of an outer circumference of the small-diameter strap ring is equal to "Rs1"; a radial dimension of an inner circumference of the large-diameter strap ring is equal to "Rs2"; a radius of a circumference which is inscribed to tip portions of the anode vanes is equal to "Ra"; and a radius of a central flat portion of the magnetic piece, which is located in the vicinity of each of the anode vanes, is equal to "Rp", the values of Ra, Rs1, Rs2, Rp are set in such a manner that the following formulae (1) and (2) can be established:

$$1.85\ Ra \leqq (Rs1+Rs2)/2 \leqq 1.96\ Ra \quad (1)$$

$$Rs1<Rp<Rs2 \quad (2).$$

In accordance with an analysis made by the Inventors of the present invention, not only the radial dimension "Rp" of the flat portion of the output-sided magnetic piece, but also a ratio of the above-described radius "Rp" to the various sorts of dimensions such as the radial dimension "Rs1" of the outer circumference of the small-diameter strap ring, the radial dimension "Rs2" of the inner circumference of the large-diameter strap ring, and also, the radius "Ra" of the circumference which is inscribed to the tip portions of the anode vanes may slightly give an influence to the radiation noise amount and the oscillation efficiency of the magnetron.

For instance, a leakage amount of fifth harmonic noise represents such a curved line characteristic, while this curved line characteristic owns a convex shape directed to a lower direction, and becomes a minimal value in the vicinity of [(Rs1+Rs2)/2]/Ra=1.90. As a consequence, since the respective values of Rs1, Rs2, Ra are set to such a proper range into which [(Rs1+Rs2)/2]/Ra can be converged in the vicinity of the minimal value, the noise leakage can be suppressed to a minimum leakage value and the radiation noise can be sufficiently reduced.

Also, an oscillation efficiency represents such a trend that a characteristic curve of this oscillation efficiency owns an inflection point in the vicinity of an area where Rp exceeds Rs2, and when this characteristic curve exceeds the inflection point, the oscillation efficiency is rapidly lowered. As a consequence, since Rp is set to a proper value in the vicinity of the inflection point, lowering of the oscillation efficiency can be avoided.

Also, noise in a 50 MHz band represents such a trend that this noise curve owns an inflection point in the vicinity of Rs1, and when this noise curve becomes lower than, or equal to this inflection point, the noise is rapidly increased. As a consequence, since the radius Rp of the flat portion is increased larger than, or equal to Rs1, leakage of the noise in the 50 MHz band can be reduced.

Accordingly, if the respective values of Ra, Rs1, Rs2, Rp are set to the setting ranges of the above-described formulae (1) and (2), then the radiation noise can be sufficiently lowered. Moreover, lowering of the oscillation efficiency can be prevented, and the oscillation efficiency can be improved.

Preferably, in the above-described magnetron, a depth dimension as to the strap-engaging concave portions provided on the upper/lower edges of each of the anode vanes is set in such a manner that the strap rings which are engaged with the strap-engaging concave portions are sunk inwardly with respect to the upper/lower edges of each of the anode vanes.

A relationship between a noise leakage amount and sunk amounts of the strap rings with respect to the edges of the anode vanes is given as follows: That is, the sunk amount represents a curved line characteristic having a convex shape directed to a lower side, and also having a minimal value within a range from 0.43 mm to 0.64 mm.

As a consequence, as explained above, since the sunk amounts are set to such a proper range in the vicinity of the minimal value, leakage of the noise can be suppressed, and further, reductions of the radiation noise can be emphasized.

Furthermore, preferably, in the above-described magnetron, an interval along an axial direction between an output-sided end hat provided on one edge of a cathode and the upper edge of each of the anode vanes is set to 0.2 to 0.4 mm.

Since the magnetron is constructed by employing such a structure that the distance along the axial direction between the output-sided end hat and the upper edge of each of the anode vanes is set to 0.2 to 0.4 mm, the noise in the 2.2 GHz band can be suppressed. The reason why the noise in the 2.2 GHz band could be suppressed in the above-described manner may be conceived as follows: That is, such a phenomenon may be reduced in which the high-frequency electric field of the antenna conductor may disturb movement of the electrons within the operating space which is formed between the center-sided edge portion of each of the anode vanes and the cathode. In other words, the thermoelectrons radiated from the cathode are accelerated by the high anode voltage which is applied between the cathode and each of the anode vanes, and further, the orbits of these thermoelectrons are bent by the magnetic field. Then, while these thermoelectrons are rotary-moved, the rotated thermoelectrons are propagated through the operation space and then are reached to the anode vanes. At this time, movement of the thermoelectrons within the operating space is disturbed by the high frequency electric field of the antenna conductor, so that these thermoelectrons may collide with each other, which may appear as noise. In order to prevent such an occurrence of the noise in the 2.2 GHz band, it can be understood that the magnetron may employ such a construction that the high frequency electric field of the antenna conductor can be hardly entered into the operating space.

DESCRIPTION OF THE PREFERRED EMBODIMENT

A magnetron according to an embodiment of the present invention will now be described in detail with reference to accompanying drawings.

Figure 1:
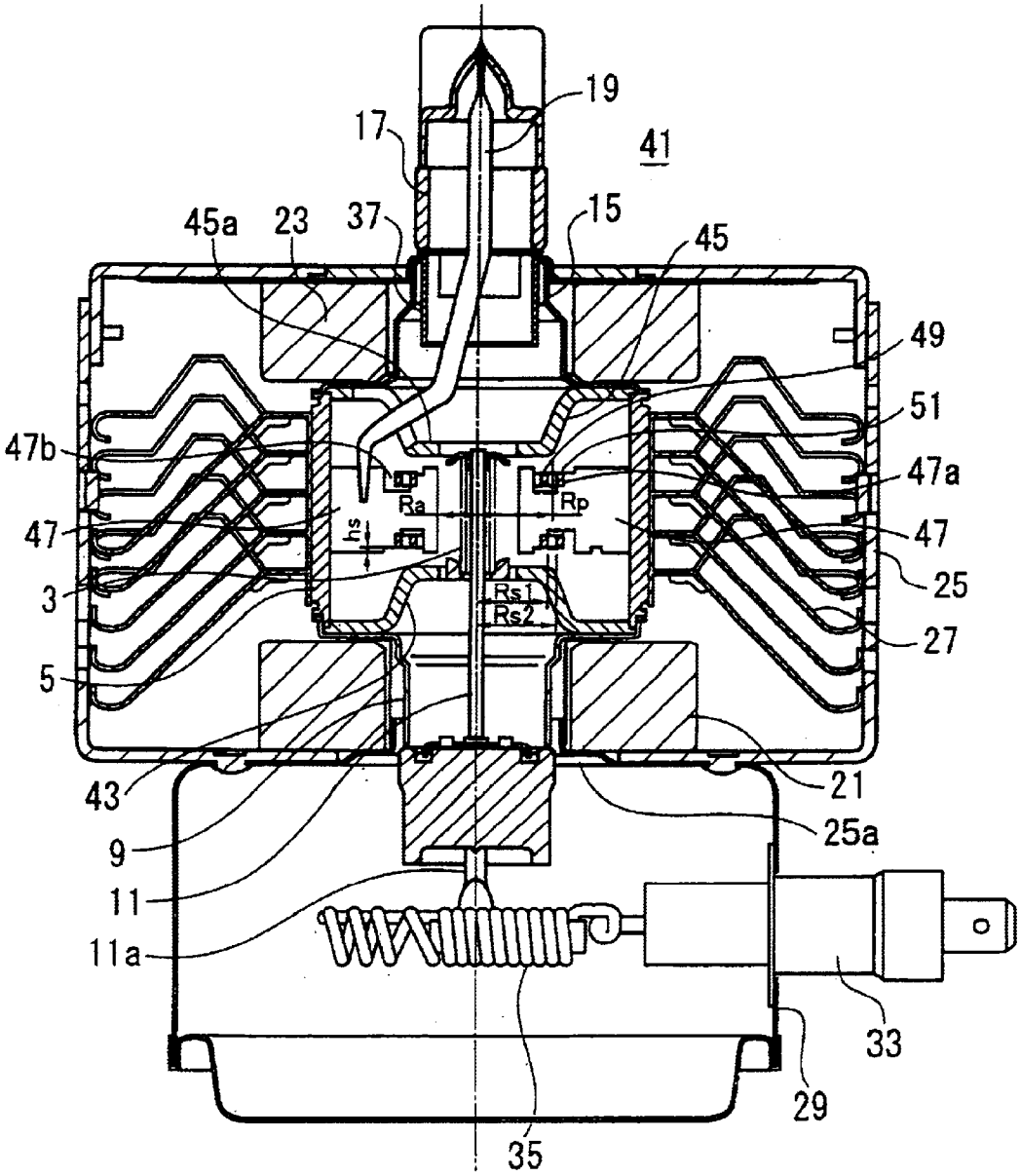
FIG. 1 is a cross-sectional diagram for showing a construction of a magnetron according to an embodiment of the present invention.

FIG. 1 is a cross-sectional diagram for indicating a magnetron 41 according to an embodiment of the present invention.

Figure 11:
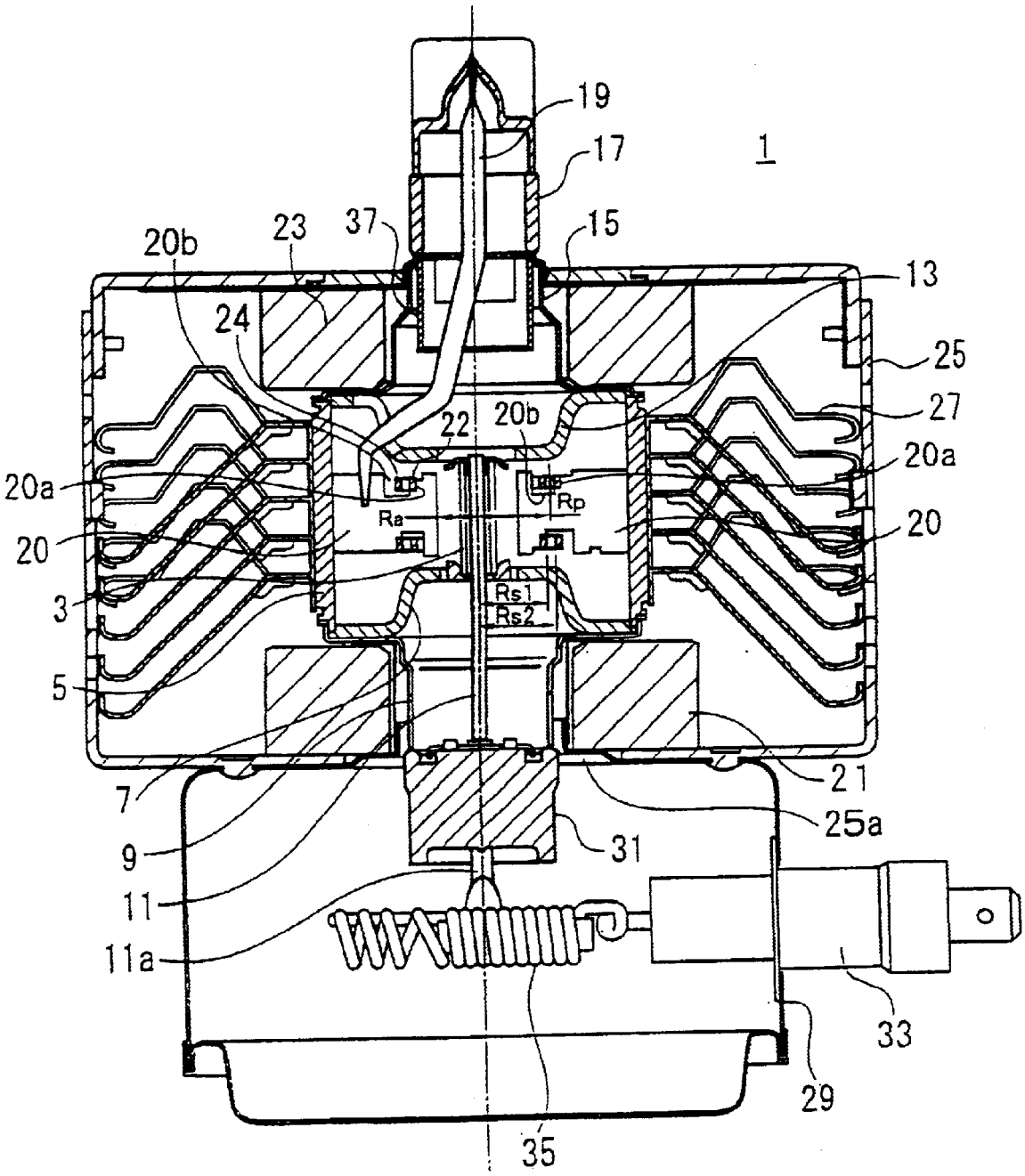
FIG. 11 PRIOR ART
FIG. 11 is a cross-sectional view for indicating the structure of the conventional magnetron.
Figure 12:
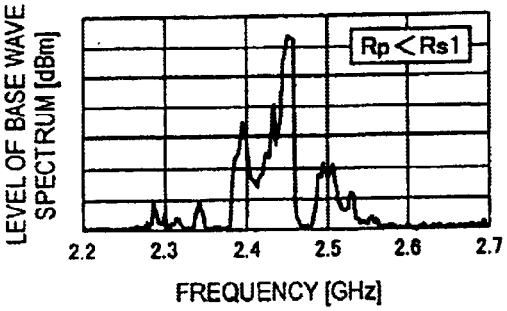
PRIOR ART FIG. 12 (a)
FIGS. 12(*a*), 12(*b*), 12(*c*), 12(*d*) and 12(*e*) are measurement diagrams for indicating such a condition that the occurrence of the sidebands is reduced on the base wave spectrum in response to the increase of the radius of the flat portion of the magnetic piece employed in the conventional magnetron.
Figure 12:
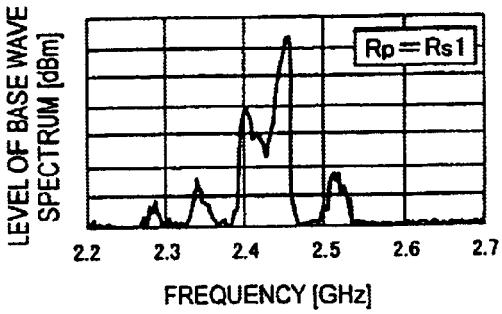
PRIOR ART FIG. 12 (b)
Figure 12:
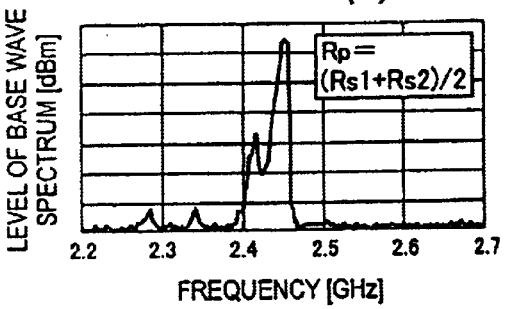
PRIOR ART FIG. 12 (c)
Figure 12:
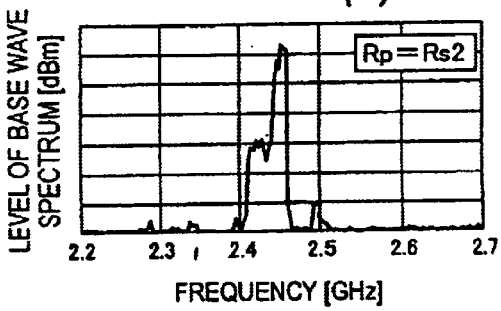
PRIOR ART FIG. 12 (d)
Figure 12:
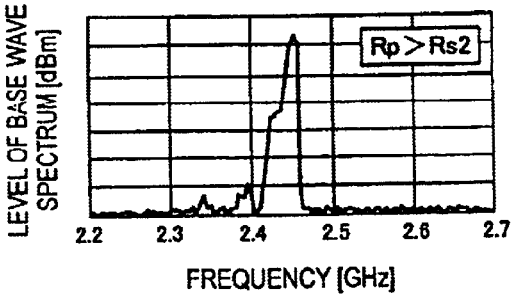
FIG. 12 (e) PRIOR ART
Figure 13:
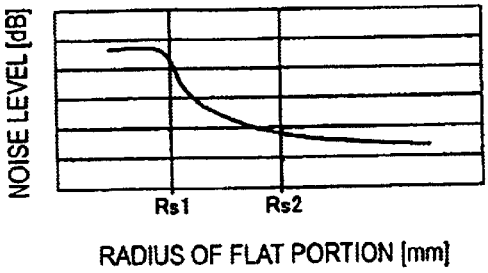
FIG. 13 PRIOR ART
FIG. 13 is a graph for graphically indicating the correlative relationship between the noise level and the radius of the flat portion of the magnetic piece employed in the conventional magnetron.

The magnetron 41 of this embodiment is constructed by replacing the input-sided magnetic piece 7 of the conventional magnetron 1 shown in FIG. 11 by an input-sided magnetic piece 43; the output-sided magnetic piece 13 there of by an output-sided magnetic piece 45; the anode vanes 20 thereof by anode vanes 47; the small-diameter strap ring 22 thereof by a small-diameter strap ring 49; and also the large-diameter strap ring 24 by a large-diameter strap ring 51. Other structures of this magnetron 41 are commonly used as those of the convential magnetron 1. It should be noted that the same reference numerals shown in FIG. 11 are employed as those for denoting these commonly-used structural elements, and therefore, explanations thereof are omitted, or will be simplified.

It should also be noted that dimensional ratios of these input-sided magnetic piece 43, output-sided magnetic piece 45, anode vanes 47, small-diameter strap ring 49 and large-diameter strap ring 51, which have been replaced, with respect to a central flat portion 45*a* of the output-sided magnetic piece 45 are devised, or contrived.

That is to say, the magnetron 42. of this embodiment is arranged as follows. The input-sided magnetic piece 43 and the output-sided magnetic piece 45 are tightly joined to both an upper edge and a lower edge of an anode tubular body 5, the center axis of which is directed to upper/lower directions. Further, a plurality of the anode vanes 47 are joined to an inner wall plane of the anode tubular body 5 in a radial shape, which are directed to a center axis of the mode tubular body 5. A strap-engaging concave portion 47*a* and a strap-inserting concave portion 47*b* are provided on an upper edge and a lower edge of each of these anode vanes 47 in such a manner that the position of the strap-engaging concave portion 47*a* is positionally shifted with respect to the position of the strap-inserting concave portion 47*b* along a radial direction, and both the strap-engaging concave portion 47*a* and the strap-inserting concave portion 47*b* are arranged in a reverse manner with respect to the upper edge and the lower edge. The strap-engaging concave portion 47*a* is employed so as to join a strap ring, whereas the strap-inserting concave portion 47*b* is employed so as to insert thereinto the strap ring in a non-contact manner. These anode vanes 47 arranged along a circumferential direction are electrically connected to each other every one vane, while any one of two strap rings 49 and 51 is joined to the strap-engaging concave portion 47*a*. These strap rings are a small-diameter strap ring 49 and a large-diameter strap ring 51, which are arranged on the center axis of the anode tubular body 5 in a coaxial manner. Furthermore, a microwave radiating antenna 19 which passes through the output-sided magnetic piece 45 in a non-contact manner is joined to an upper edge of one anode vane among the plural anode vanes 47.

Figure 2:
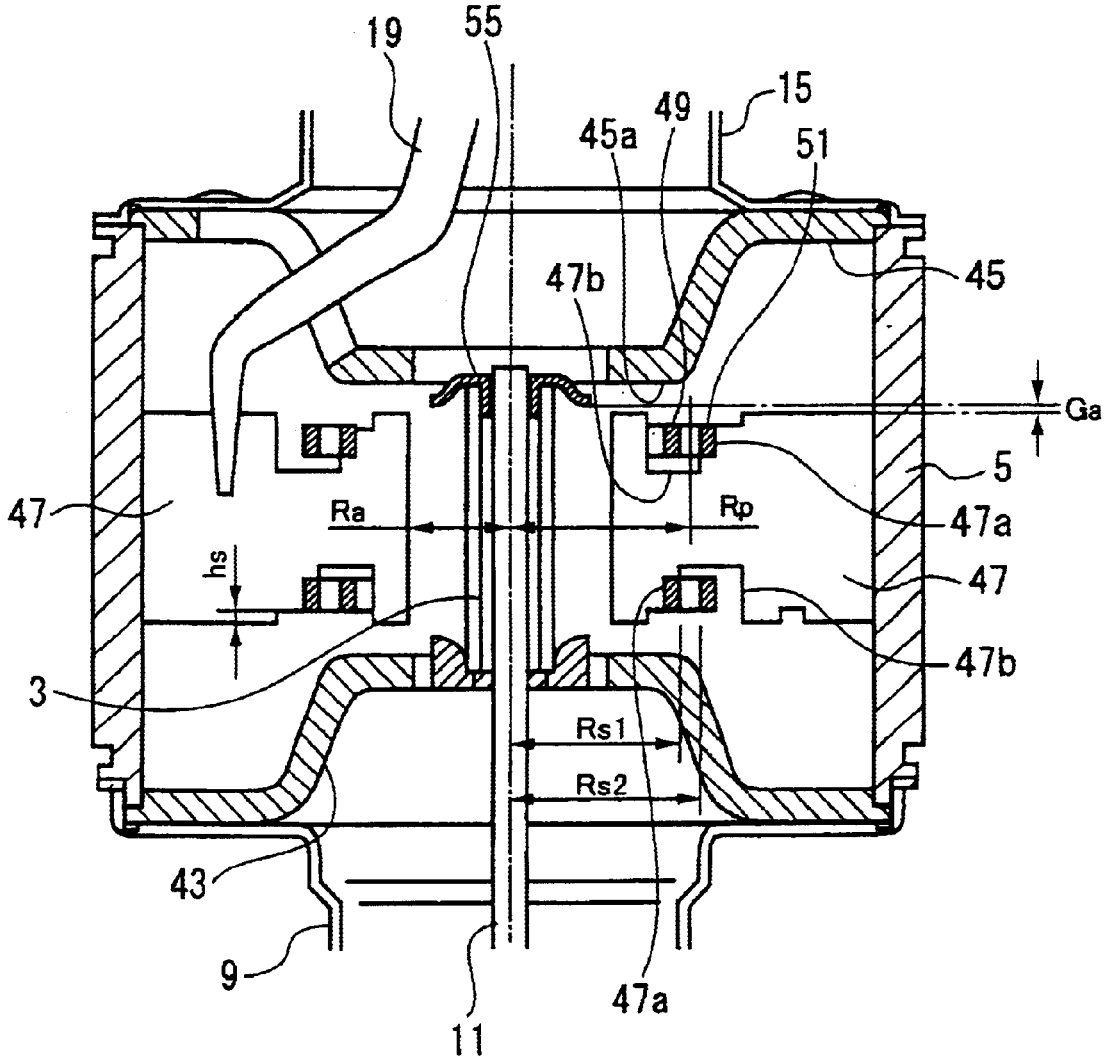
FIG. 2 is an enlarged view for indicating a major structure of the magnetron shown in FIG. 1.

Then, as illustrated in FIG. 2, assuming now that a diameter dimension of an outer circumference of the small-diameter strap ring 49 is equal to "Rs1"; a diameter dimension of an inner circumference of the large-diameter strap ring 51 is equal to "Rs2"; a diameter of a circumference which is inscribed to a tip portion of the anode vane 47 is equal to "Ra"; and also, a diameter of a central flat portion of the output-sided magnetic piece 45 is equal to "Rp" which is located in the vicinity of each of the anode vanes 47, the respective values of Ra, Rs1, Rs2, Rp are set in order to satisfy the following formula (1) and formula (2):

$$1.85\ Ra \leqq (Rs1+Rs2)/2 \leqq 1.96\ Ra \quad (1)$$

$$Rs1<Rp<Rs2 \quad (2)$$

As shown in FIG. 2, in this embodiment, as to the strap-engaging concave portion 47*a* of the upper/lower edges of each of the anode vanes 47, a depth dimension "hs" thereof is set in such a manner that the strap ring to be engaged with this strap-engaging concave portion 47*a* is sunk inwardly from the upper/lower edges of each of the anode vanes 47.

Also, in this embodiment, as shown in FIG. 2, a distance "Ga" between an output-sided end hat and an upper edge of each of the anode vanes 47 along an axial direction is set to 0.2 to 0.4 mm, while this output-sided end hat 55 is provided on the upper end of the cathode 3.

Figure 3:
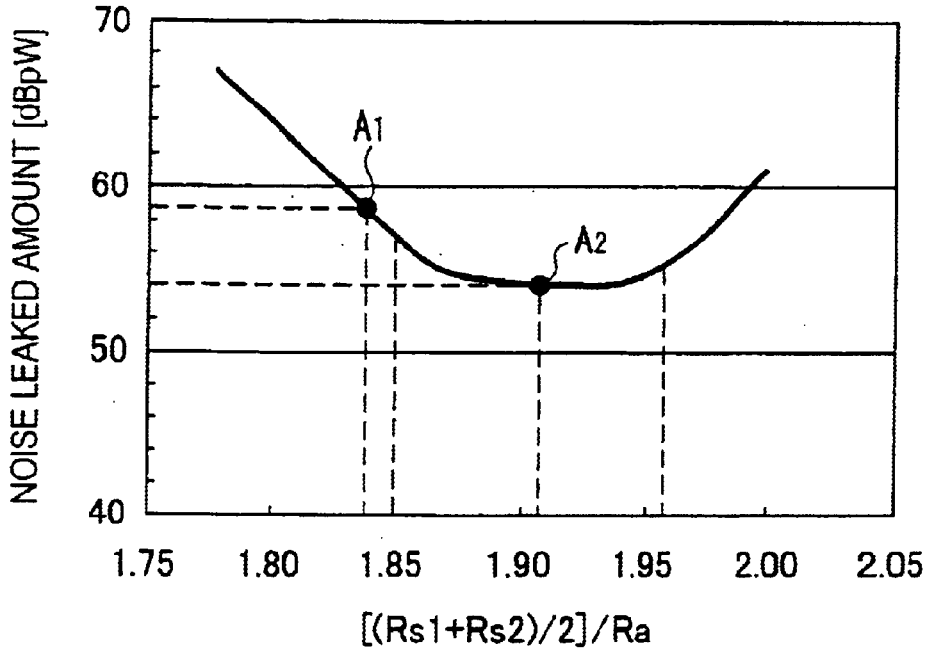
FIG. 3 is a graph for graphically representing a relationship between a dimension of a strap ring and fifth harmonic noise in the magnetron according to the embodiment of the present invention.

In accordance with experiments and analysises made by the Inventors of the present invention, a leakage amount of high frequency noise (involving fifth harmonic noise as initial noise) represents such a curved line characteristic as indicated in a point "A2" of FIG. 3, while this curved line characteristic owns a convex shape directed to a lower direction, and becomes a minimal value in the vicinity of [(Rs1+Rs2)/2]/Ra=1.90. Since the respective values of Rs1, Rs2, Ra are set to such a range capable of satisfying the above-explained formula (1), the leakage amounts of the high frequency noise can be suppressed to substantially minimum values of 54 to 55 dBpW.

Figure 4:
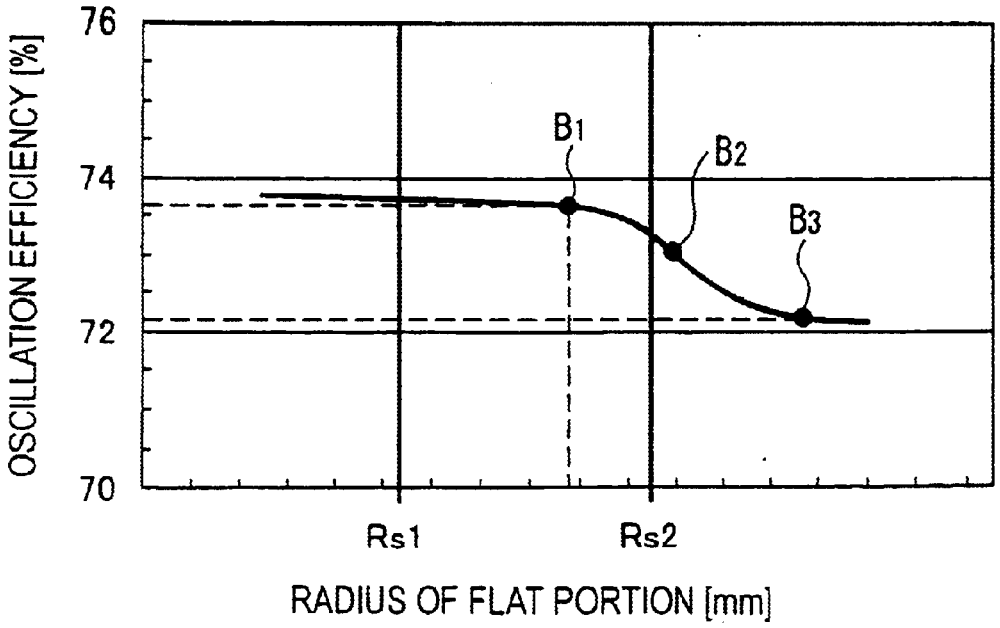
FIG. 4 is a graph for graphically indicating a relationship between a flat portion of a magnetic piece and an oscillation efficiency in the magnetron according to the embodiment of the present invention.
Figure 5:
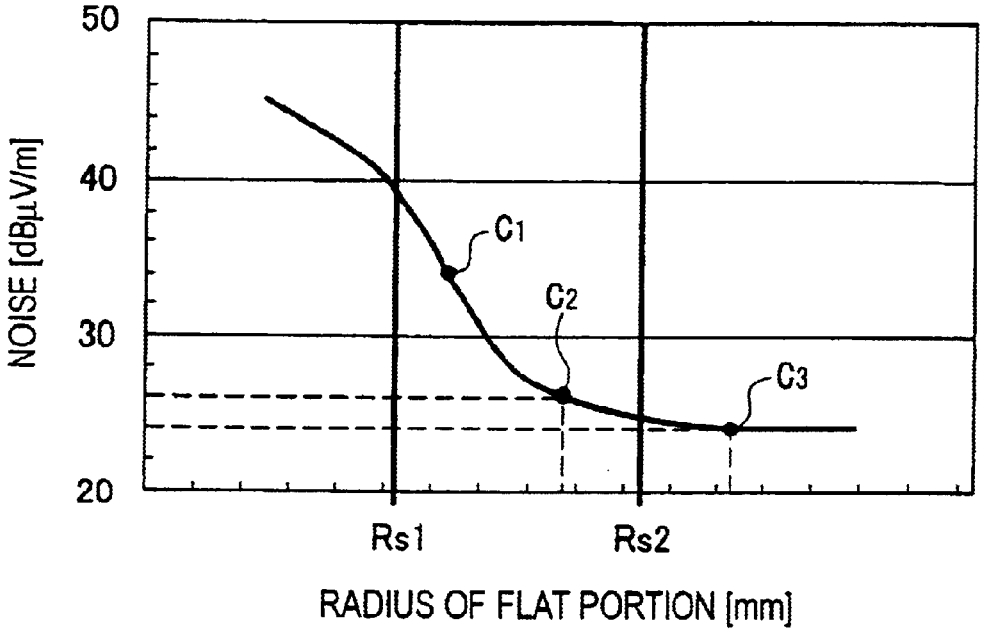
FIG. 5 is a graph for graphically indicating a relationship between the flat portion of the magnetic piece and noise of 50 MHz band in the magnetron according to the embodiment of the present invention.

Further, as indicated in FIG. 4, an oscillation efficiency represents such a trend that a characteristic curve of this oscillation efficiency owns an inflection point "B2" in the vicinity of an area where Rp (radius of flat portion) exceeds Rs2 (radial dimension of large-diameter strap ring 51), and when this characteristic curve exceeds the inflection point B2, the oscillation efficiency is rapidly lowered. Also, as indicated in FIG. 5, noise of a low frequency range (50 MHz band) represents such a trend that this noise curve owns an inflection point "C1" in the vicinity of Rs1 (radial dimension of small-diameter strap ring 49), and when this noise curve becomes lower than, or equal to this inflection point C1, the noise is rapidly increased.

As a consequence, since the respective values of Rs1, Rs2, Rp are set to such a range where the above-explained formula (2) can be satisfied, the oscillation efficiency can be improved, and also, the noise leakage of the low frequency range can be prevented.

In other words, in the magnetron 41 of this embodiment, since the respective values of Rs1, Rs2, Ra are set in such a manner that the above-described formula (1) can be satisfied, the leakage amounts of the high frequency noise (involving fifth harmonic noise as initial noise) can be suppressed to such a leakage amount lower than, or equal to a predetermined noise leakage amount. Moreover, since the respective values of Rs1, Rs2, Ra are set in such a manner that the above-explained formula (2) can be satisfied, the oscillation efficiency can be improved, and at the same time, the noise leakage of the low frequency range can be prevented. After all, the radiation noise over the all frequency ranges can be sufficiently lowered. In addition, while lowering of the oscillation efficiency can be prevented, the oscillation efficiency can be improved.

Also, a relationship between a noise leakage amount and sunk amounts of the strap rings with respect to the edges of the anode vanes 47 is given as follows: That is, as shown in points "D1" and "D2" of FIG. 6, the sunk amount represents a curved line characteristic having a convex shape directed to a lower side, and also having a minimal value within a range from 0.43 mm to 0.64 mm. As a result, a depth of the strap-engaging concave portion 47*a* is set in such a manner that the sunk amount may be defined within the range from the point D1 to the point D2, or near this range. Therefore, the amount of noise which is caused by the positions of the anode traps 49 and 51 with respect to the edges of the anode vanes can be suppressed to such a value in the vicinity of the minimal value. Moreover, reductions of the radiation noise can be emphasized.

In accordance with the comparison experiments made by the Inventors of the present invention, in the case of such a conventional magnetron that the radiuses of the respective structural elements were set to satisfy Rp>Rs2 and [(Rs1+Rs2)/2]/Ra=1.84, a clear spectrum having no base wave sideband could be recognized. However, the following results were obtained. That is, the oscillation efficiency was 72.2%, namely a point B3 of FIG. 4; the fifth harmonic noise was 59 dBpW, namely the point A1 of FIG. 3; and the noise in the 50 MHz range was 24 dBμV/m, namely a point C3 of FIG. 5.

In contrast to this conventional magnetron, in the case of such a magnetron according to the present invention that the radiuses of the respective structural elements were set to satisfy Rs1<Rp<Rs2 and [(Rs1+Rs2)/2]/Ra=1.91, not only a clear spectrum having no base wave sideband could be recognized, but also the following results were obtained. That is, the oscillation efficiency was 73.6%, namely a point B1 of FIG. 4; the fifth harmonic noise was 54 dBpW, namely the point A2 of FIG. 3; and the noise in the 50 MHz range was 26 dBμV/m, namely a point C2 of FIG. 5.

In other words, as to the oscillation efficiency, the improvement of 1.4% could be confirmed. Furthermore, as to the fifth harmonic noise, the improvement of 5 dB could be confirmed. Therefore, the effective characteristics of the construction of the magnetron according to the present invention could be proved.

Figure 6:
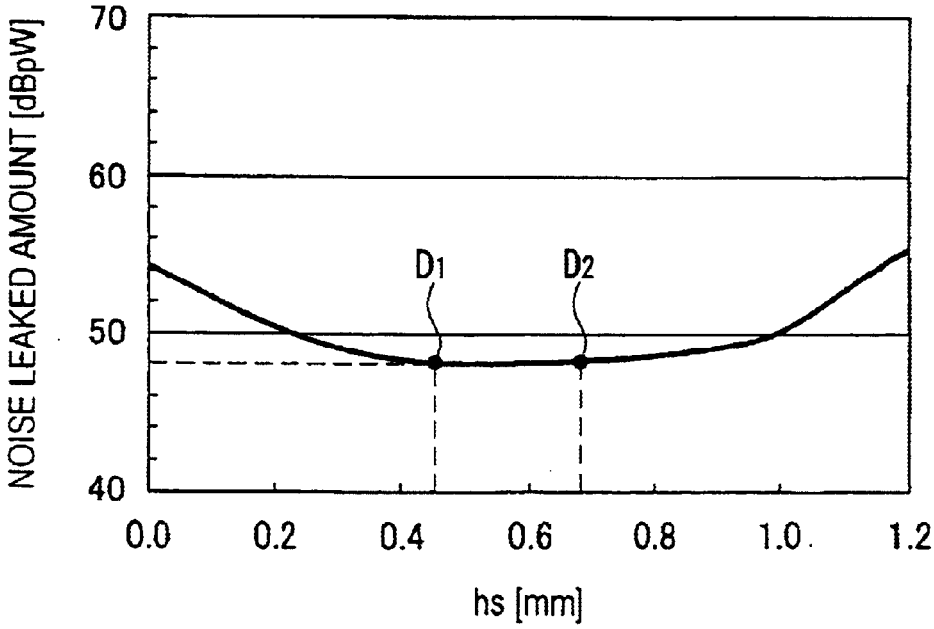
FIG. 6 is a graph for graphically indicating a relationship between noise and a sunk amount of the strap ring in the magnetron according to the embodiment of the present invention.

Also, in a magnetron according to an embodiment of the present invention, in which both the small-diameter strap ring 49 and the large-diameter strap ring 51 are sunk into the strap-engaging concave portions 47*a* of the anode vanes 47, the fifth harmonic noise indicates 48 dBpW of a minimal point shown in FIG. 6. This fifth harmonic noise of this magnetron could be confirmed as to considerable improvements of 11 dB, as compared with that of the conventional magnetron.

Figure 7:
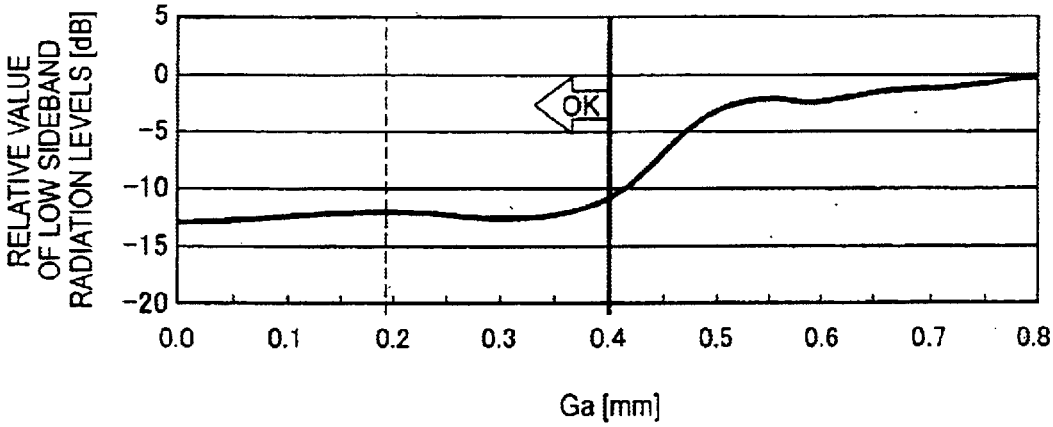
FIG. 7 is a graph for graphically indicating a relationship between an end hat-to-vane distance and a low sideband radiation level relative value in the magnetron according to the embodiment of the present invention.
Figure 8:
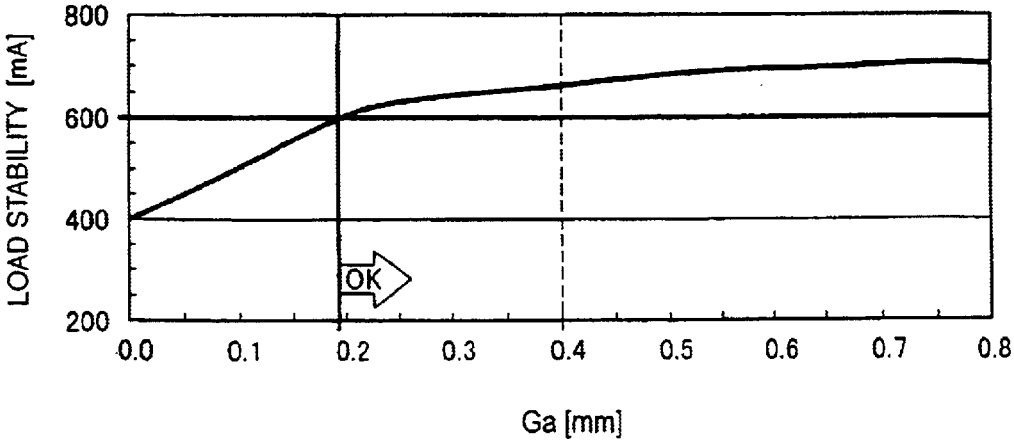
FIG. 8 is a graph for graphically indicating a relationship between the end hat-to-vane distance and a load stability in the magnetron according to the embodiment of the present invention.
Figure 9:
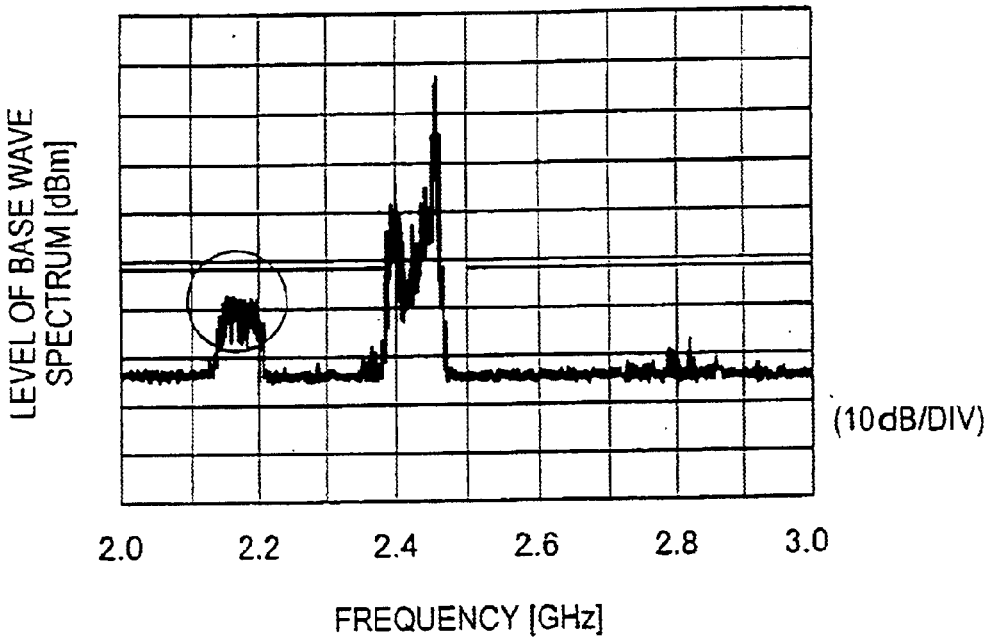
FIG. 9 is a graph for graphically indicating an improvement example of noise in 2.2 GHz band in the magnetron according to the embodiment of the present invention.
Figure 10:
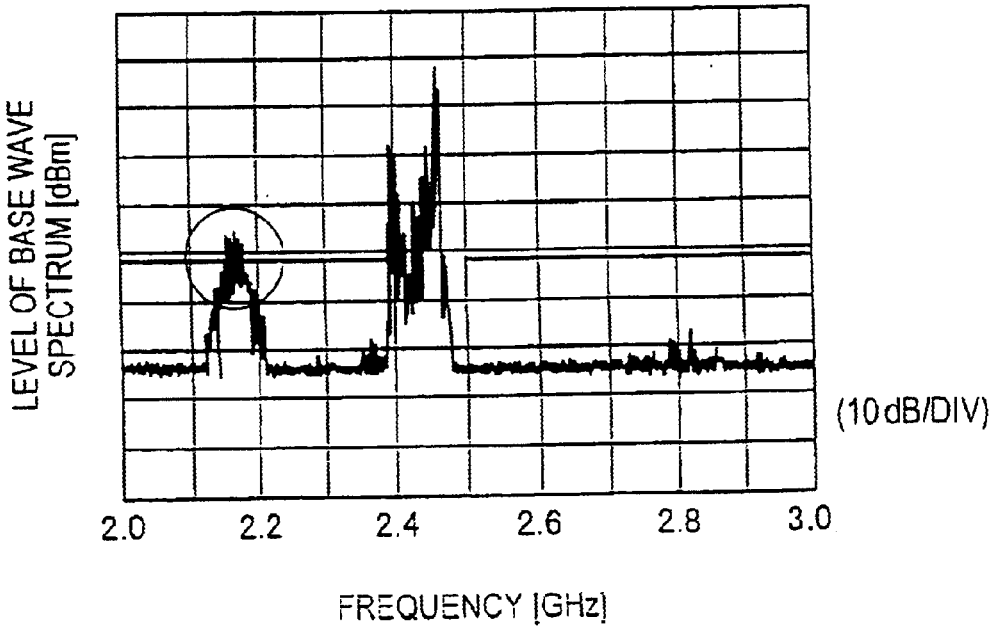
FIG. 10 PRIOR ART
FIG. 10 is a graph for graphically indicating the noise in the 2.2 GHz band in the conventional magnetron.

Furthermore, in such a magnetron according to an embodiment of the present invention, in which a distance "Ga" along an axial direction between the output-sided end hat 55 provided on the upper end of the anode 3 and the upper edge of each of the anode vanes 47 is set to 0.2 to 0.4 mm, a relative value of low sideband radiation levels becomes a low value (approximately −13 dB), as compared with such a case that the distance "Ga" exceeds 0.4 mm as indicated in FIG. 7. Also, in addition, with respect to a relationship between the distance "Ga" and a load stability, as represented in FIG. 8, the load stability may take a stable value (approximately 600 mA). In this case, although the load stability may take the stable value after the distance Ga exceeds the length of 0.2 mm, since the relative value of the low sideband radiation levels is rapidly increased from the distance Ga of 0.4 mm, the distance Ga may be eventually converged within the range from 0.2 mm to 0.4 mm. As a result of an experiment, the following fact could be confirmed. That is, since the distance Ga was set to such a value, as shown in FIG. 9, the noise in the 2.2 GHz band could be suppressed by approximately 10 dB. Also, another fact could be confirmed. That is, since a better load stability could be obtained within such a range that the distance Ga was defined between 0.2 mm and 0.4 mm, stable oscillation could be carried out irrespective of the loads.

The reason why the noise in the 2.2 GHz band could be suppressed in the above-described manner may be conceived as follows: That is, as previously explained, such a phenomenon may be reduced in which the high-frequency electric field of the antenna conductor 19 may disturb movement of the electrons within the operating space which is formed between the center-sided edge portion of each of the anode vanes 47 and the cathode 3. In other words, the thermoelectrons radiated from the cathode 3 are accelerated by the high anode voltage which is applied between the cathode 3 and each of the anode vanes 47, and further, the orbits of these thermoelectrons are bent by the magnetic field. Then, while these thermoelectrons are rotary-moved, the rotated thermoelectrons are propagated through the operation space and then are reached to the anode vanes. At this time, movement of the thermoelectrons within the operating space is disturbed by the high frequency electric field of the antenna conductor 19, so that these thermoelectrons may collide with each other, which may appear as noise. However, since the magnetron is constructed in such a manner that the high frequency electric field of the antenna conductor 19 can be hardly entered into the operating space, the disturbance of movement of the thermoelectrons within the operating space may be reduced, so that occurrences of collisions among these thermoelectrons may be decreased. As a result, occurrences of the noise can be reduced.

In accordance with the magnetron of the present invention, since the respective values of Rs1, Rs2, Ra are set in such a manner that the above-described formula (1) can be satisfied, the leakage amounts of the high frequency noise (involving fifth harmonic noise as initial noise) can be suppressed to such a leakage amount lower than, or equal to a predetermined noise leakage amount. Moreover, since the respective values of Rs1, Rs2, Ra are set in such a manner that the above-explained formula (2) can be satisfied, the oscillation efficiency can be improved, and at the same time, the noise leakage of the low frequency range can be prevented. After all, the radiation noise over the all frequency ranges can be sufficiently lowered. In addition, while lowering of the oscillation efficiency can be prevented, the oscillation efficiency can be improved.

Also, according to the present invention, the amount of noise which is caused by the positions of the anode traps 49 and 51 with respect to the edges of the anode vanes can be suppressed to such a value in the vicinity of the minimal value. Moreover, reductions of the radiation noise can be emphasized.

Also, according to the present invention, the noise in the 2.2 GHz band can be improved, and further, the stable oscillation can be achieved irrespective of the load condition.

What is claimed is:

1. A magnetron, in which both a strap-engaging concave portion for joining a strap ring and a strap-inserting concave portion for inserting therethrough the strap ring in a non-contact manner are provided on an upper edge and a lower edge of each of anode vanes in a manner that the strap-engaging concave portion and the strap-inserting concave portion are positionally shifted from each other along a radial direction of an anode tubular body; the anode vanes arranged along a circumferential direction are electrically connected to each other by any one of a small-diameter strap ring and a large-diameter strap ring coaxially arranged with respect to a center axis of the anode tubular body, is joined to the strap-engaging concave portion; and a microwave radiating antenna passing through an output-sided magnetic piece in a non-contact manner is joined to one anode vane among the anode vanes, wherein, in such a case that a radial dimension of an outer circumference of the small-diameter strap ring is Rs1 a radial dimension of an inner circumference of the large-diameter strap ring is Rs2 a radius of a circumference inscribed to tip portions of the anode vanes is Ra and a radius of a central flat portion of the output sided magnetic piece located in a vicinity of each of the anode vanes is Rp, values of Ra, Rs1, Rs2, Rp are set in a manner that satisfies both following formulae (1) and (2):

$$1.85Ra \leqq (Rs1+Rs2)/2 \leqq 1.96Ra \quad (1)$$

$$Rs1<Rp<Rs2 \quad (2).$$

2. A magnetron according to claim 1 wherein a depth dimension of the strap-engaging concave portions provided on the upper and/or lower edges of each of the anode vanes is set in a manner that the strap rings engaged with the strap-engaging concave portions are sunk inwardly with respect to the upper and/or lower edges of each of the anode vanes.

3. A magnetron according to claim 1 wherein an interval along an axial direction between an output-sided end hat provided on one edge of a cathode and the upper edge of each of the anode vanes is set to 0.2 to 0.4 mm.

* * * * *